United States Patent [19]

Sato et al.

[11] Patent Number: 4,842,041

[45] Date of Patent: Jun. 27, 1989

[54] METAL STRIP MANUFACTURING METHOD AND NOZZLE THEREFOR

[75] Inventors: Yuichi Sato; Takashi Sato; Toshio Yamada, all of Kawasaki, Japan

[73] Assignee: Nippon Steel Corporation, Otemachi, Japan

[21] Appl. No.: 137,755

[22] Filed: Dec. 24, 1987

[30] Foreign Application Priority Data

Jun. 11, 1987 [JP] Japan ..... 62-145706

[51] Int. Cl.[4] ..... B22D 11/06; B22D 37/00

[52] U.S. Cl. ..... 164/463; 222/575; 222/594; 164/423; 164/135

[58] Field of Search ..... 164/463, 479, 423, 429, 164/337, 437, 135; 222/575, 591, 594

[56] References Cited

U.S. PATENT DOCUMENTS 4,177,856 12/1979 Liebermann ..... 164/423
4,221,257 9/1980 Narasimhan .
4,485,839 12/1984 Ward ..... 164/463

FOREIGN PATENT DOCUMENTS 3411466 10/1984 Fed. Rep. of Germany ..... 164/423
55-18582 1/1980 Japan .

*Primary Examiner*—Kuang Y. Lin

[57] ABSTRACT

In the continuous manufacturing of metal strip from molten alloy, the nozzle from which the melt issues to form the continuous strip by rapid-cooling solidification has an orifice that is discontinuous in the width direction of the strip; i.e., it is a multiple orifice. This enables amorphous and crystalline continuous metal strip to be produced in much greater widths than has hitherto been possible, and the strip thus produced is more uniform in thickness.

18 Claims, 3 Drawing Sheets

METAL STRIP MANUFACTURING METHOD AND NOZZLE THEREFOR

BACKGROUND OF THE INVENTION

1. Field of the Invention

The present invention relates to a method of continuously manufacturing amorphous metal strip or crystalline metal strip by quench-solidification on the surface of a moving chill body of molten metal.

2. Description of the Prior Art

Various means have been disclosed relating to methods of continuously manufacturing strip from molten metal (continuous melt quenching method). In each case the molten alloy is ejected under a specific pressure from a nozzle having an orifice of a specific shape, and strikes a moving chill body that faces the nozzle orifice to be thereby solidified into continuous strip.

The important manufacturing factors at this time are the shape of the nozzle orifice, the relative positional arrangement of the nozzle and the chill body, the pressure at which the molten alloy is ejected from the nozzle, and advancing the chill surface at a predetermined speed. With respect to these manufacturing factors, in general, conditions tend to become narrower and more stringent as the width of the strip increases.

Japanese Patent Laid Open No. 53 (1978)-53525, "Method and apparatus for continuous casting of metal a strip", is a representative example of means that have been disclosed for manufacturing wide strip, and in outline comprised a slotted nozzle positioned generally perpendicular to the direction of movement of a chill surface and located in close proximity to the chill surface to provided a gap of from about 0.03 to about 1 mm between the nozzle and the chill surface, molten alloy was ejected from the nozzle onto the chill surface at a velocity of 100 to 2,000 meters per minute for forming continuous strip by means of thermal-contact rapid-cooling solidification.

In the above-mentioned conventional method, in principle there is no limitation on the width of the strip. That is, if the length of the rectangular orifice (the length of the orifice measured in a direction that is at right-angles to the direction of movement of the chill surface) was increased, the width of the strip could be increased.

However, in practice, as the length of the rectangular orifice was increased it became difficult to maintain the parallelism of the orifice during the casting. Specifically, as shown in FIGS. 3*a* and 3*b*, convex or concave deformation of the nozzle portion caused by thermal expansion, deformation resulting from non-uniformity of the temperature and the like made it difficult to maintain the parallelism of the orifice. When the parallelism of the rectangular nozzle is thus lost, the thickness of the formed strip, especially in the direction of the width, becomes non-uniform. Accordingly, conventionally, the wider the strip became the more difficult it has been to produce strip having uniform thickness across its width. Also, strip that is of non-uniform thickness is undesirable because when such strip is laminated or coiled, for example, the space factor deteriorates. At present it is possible to keep thickness deviation in 25-mm-wide strip down to 5 to 10 per cent, but in the case of strip 150 mm in width it difficult to keep the deviation to 10 per cent or less. Thus, with conventional methods the width of the strip was subject to a technical limitation. As far as the present inventors know, at present the width of the widest rapid-cooled strip is around 300 mm. However, strip of this width is being produced only on an experimental basis, and it is difficult to consider that production stability is such as to permit commercial mass-production.

SUMMARY OF THE INVENTION

An object of the present invention is to remove constraints on width in the continuous manufacturing of metal strip from molten alloy by reducing non-uniformity of strip that with conventional methods often resulted from deformation of the nozzle portion during the manufacture of wide strip, and increasing the strength of the nozzle portion.

The present invention attains the above object on the basis of new knowledge that, in contrast to the conventional method of manufacturing wide strip using a nozzle having a slot-shaped rectangular orifice, wide strip possessing the same flatness as strip produced according to the conventional method can be manufactured using a nozzle that has an orifice that is discontinuous in the width direction of the strip. The method according to the present invention does not have the drawbacks associated with conventional methods, and enables the width of the strip to be increased without limit.

DESCRIPTION OF THE PREFERRED EMBODIMENTS

Figure 1:
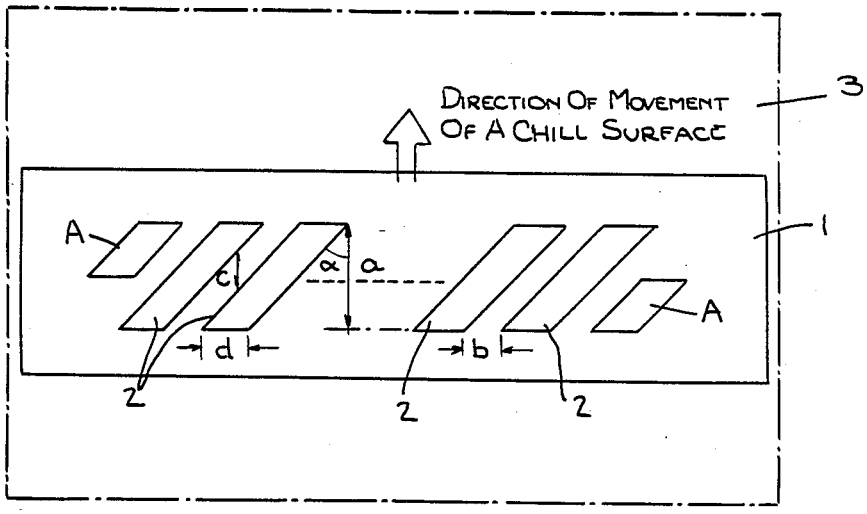
FIGS. 1 and 2 are explanatory drawings showing the shape and arrangement of the nozzle orifices used in the method according to the present invention.

The nozzle used in the method of the present invention is for example the kind of multiple-orifice nozzle 1 illustrated in FIG. 1. Orifices 2 are each a slender parallelogram in shape with the sides inclined in the direction of movement of a cooling surface 3 (indicated by the phantom line (single-dot chain line)). The orifices 2 are arrayed in a mutually parallel arrangement at right angles to the direction of movement.

The parameters defining the structure of the multiple-orifice nozzle 1 employed in the method of this invention as illustrated in FIG. 1 are side d of the orifice 2 parallelogram; spaces b, c, by which adjacent orifices are separated; angle of inclination $\alpha$ of each parallelogram relative to the direction of travel of the cooling plate 3; and the height a of the parallelograms. In general, a is larger than d and the shape is long and slender.

With respect to the range of parameter dimensions, the orifice angle of inclination α is 10–80 degrees, the length of the lower side d is 0.1–2.0 mm, the height a is 0.5–8.0 mm, and as the separation between adjacent orifices, preferably a distance b in the direction of the orifice array is within the range 0.2–3.0 mm and the distance c in the direction of travel of the cooling plate 3 is within the range 0.2–4.0 mm.

Of the shape parameters, the distance c in the direction of movement of the chill surface 3 is important. It was found that if the said distance c exceeded 4.0 mm, strip having a good shape would not be formed. This is of special importance when it is amorphous alloy strip that is to be manufactured, wherein if 4.0 mm is exceeded the strip thus produced is often crystallized. Other shape parameters shown are the preferred ranges for embodiments in practicing of the present invention. For example, height a is a parameter related to the strip thickness and is preferably within the range 0.5–8.0 mm; the lower limit is set at a value that eliminates difficulties in the manufacture of the nozzle.

The major fear in the method according to the present invention is whether there will appear in the formed strip longitudinal strand-shaped hollows or open portions, or protrusions. Such strip is regarded as a product of low commercial value, tending as it does to produce a lowering of the space factor when it is utilized as a core material.

Unexpectedly, however, tests confirmed that selection of correct combinations within the parameter ranges proposed for the method of the present invention enabled strip to be obtained which substantially was free of the aforementioned strand-shaped hollows or protrusions, and therefore there was almost no lowering of the space factor.

The method according to the present invention goes beyond the conventional state of knowledge of the art as recited in columns 2 to 3 of the Official Gazette entry for Japanese Laid Open Publication No. 53 (1978)-53525 in the point that the thickness of strip formed by the ejection of the molten alloy from a nozzle having a plurality of orifices in the width direction of the strip is substantially uniform.

In addition, it was found that as, if the method of the present invention is adopted, there are none of the drawbacks associated with the conventional method, constraints on the width of the strip are removed and the strip can be made wider.

The method used according to the present invention, as already described, is what is referred to as the single-roll rapid-cooling method, a variation of the melt rapid-cooling method, wherein molten metal is forced onto the chill surface 3 under the pressure by means of nozzle 1 for thermal-contact rapid-cooling solidification. It goes without saying that this also includes centrifugal cooling type methods in which the inner wall of a drum is utilized, as well as improvements thereto such as, for example, methods using auxiliary rolls or attachments such as a roll-surface-temperature control means, or casting under reduced pressure or in a vacuum, or in an inert gas.

Casting conditions employed with the method of the present invention will now be described. The distance between the nozzle tip and the chill surface is in the range of about 0.05–about 3.0 mm. The molten metal ejection pressure is 0.01–2.0 kg/cm$^2$ and the travel speed of the chill surface is 5–50 m/sec. The optimum value the above mentioned distance and travel speed within this range will be selected according to the structure of the nozzle.

Figure 2:
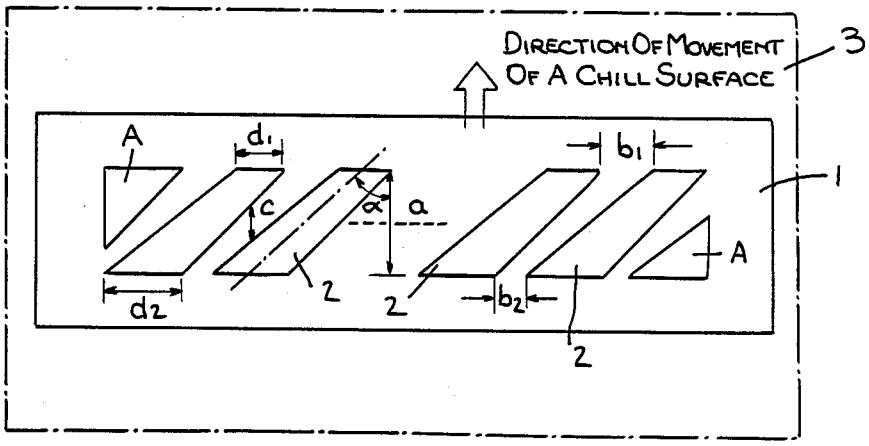
Figure 3A:
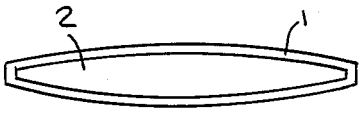
FIG. 3 is an explanatory drawing showing deformation of a slot-shaped nozzle caused by thermal expansion.
Figure 3B:
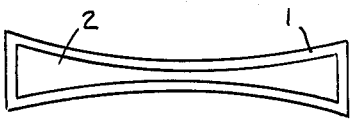

With respect to the shape of the nozzle orifices, there are a number of possible variations within the range of the basic concept that has been described. For example, an orifice may be trapezoidal in shape, as shown in FIG. 2. In this case, the angle of inclination α of the orifice with respect to the direction of movement of the chill surface is 10–80 degrees, the lengths d1 and d2 of the upper and lower legs are each 0.1–6.0 mm and as the separation between adjacent orifices, preferably distances b1 and b2 in the direction of the orifice array are within the range 0.2–6.0 mm and the distance c in the direction of travel of the chill surface 3 is within the range 0.2–7.0 mm, and the height a within the range 0.5–8.0 mm.

Here, the angle of inclination α of the orifice with respect to the direction of movement of the chill surface, as shown in FIG. 2, is the angle formed between a line joining the respective midpoints of the upper and lower sides of the trapezoidal orifices and the direction of movement of the chill surface 3. In FIG. 2, with regard to the d1 and d2 of the upper and lower sides of the trapezoidal orifice, d1 is shown as smaller than d2, but if it is within the aforementioned range, d1 may be larger than d2.

Figure 8:
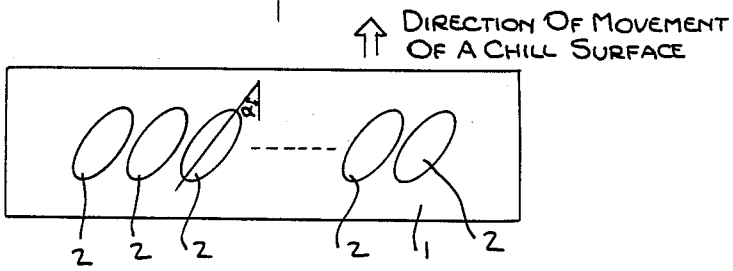
FIG. 8 is an explanatory drawing showing the shape and arrangement of nozzle orifices that may be used according to the method of the present invention.

The nozzle orifices may also be ellipsoidal in shape as shown in FIG. 8. In this case, preferably the angle of inclination α of the orifices relative to the direction of movement of the chill surface 3 is 10–80 degrees, the length of the short diameter is 0.1–3.0 mm, the length of the long diameter is 0.5–10.0 mm and the narrowest distance between adjacent orifices is in the order of 0.2 mm. Here, α refers to the angle between the long diameter and the direction of movement of the chill surface. Moreover, orifices may be polygonal in shape, such as hexagonal.

The provision at the edge portions of additional small triangular/parallelogram/trapezoid orifices such as are shown in FIGS. 1A and 2A is an effective way of ensuring strip does not become thinner at the edge portions. The shapes and dimensions of these small orifices will be selected according to the shapes and positioning of adjacent orifices. The height will be in the range 0.5–7.0 mm. The length of the lower side thereof will be about the same as the length of the lower side of adjacent orifices. However if the angle α should exceed 60 degrees, making the length of the lower side longer than the length of the lower side of the adjacent orifice, or adding a plurality of small orifices, is effective.

The various conditions described in the foregoing are mutually interrelated, not independent. Accordingly, what constitutes an optimum combination is determined by experiment. Desirable parameter combinations are shown below in the form of examples.

The advantages are particularly marked when the method of this invention is applied to alloys which readily become amorphous and to metals which are difficult to roll or otherwise process, but the method is not limited to such applications.

TABLE 1

| Slot-shape | Casting conditions |
|---|---|
| | Roll |

TABLE 1-continued

| | Orifice shape | a | b | d | α | No. of orfices | Composition (at %) | Ejection pressure | surface velocity | Strip shape Width | Strip shape Thickness |
|---|---|---|---|---|---|---|---|---|---|---|---|
| Sample 1 | Paral-lelogram | 2 mm | 0.7 mm | 0.9 mm | 45° | 14 | $Fe_{30.5}Si_{6.5}B_{12}C_1$ | 0.2 kg/cm$^2$ | 24 m/s | 25 mm | 36 km |
| Sample 2 | Paral-lelogram | 4 | " | 0.6 | " | 16 | $Fe_{30.5}Si_{6.5}B_{12}C_1$ | " | " | 24.5 | 62 |
| Sample 3 | Paral-lelogram | " | " | " | " | 16 Small orifices: 2 | $Fe_{30.5}Si_{6.5}B_{12}C_1$ | " | " | 25 | 64 |
| Sample 4 | Trapezoid | 2 | $b_1$ 1 $b_2$ 0.5 | $d_1$ 1 $d_2$ 1.5 | 48 | 12 Small orifices: 2 | $Fe_{30.5}Si_{6.5}B_{12}C_1$ | " | " | " | 45 |
| Sample 5 | Trapezoid | 4 | " | " | " | " | $Fe_{79}Si_5B_{13}$ | " | 12 | " | 92 |
| Sample 6 | Paral-lelogram | 2 | 0.7 | 1 | 26 | 42 Small orifices: 2 | $Fe_{79}Si_5B_{13}$ | " | 24 | 74 | 42 |
| Sample 7 | Paral-lelogram | 1 | " | " | " | " | $Fe_{75}Ni_5Mo_4B_{12}C_4$ | " | " | " | 32 |
| Sample 8 | Paral-lelogram | 1.5 | " | " | 37 | " | $Co_{69}Fe_4Mo_2Si_{16}B_9$ | " | " | 74.5 | 38 |
| Sample 9 | Paral-lelogram | " | " | " | 30 | 88 Small orifices: 2 | $Fe_{72}Co_{10}Mo_2B_{12}C_4$ | " | 28 | 151 | 35 |
| Sample 10 | Paral-lelogram | " | " | " | " | 130 Small orifices: 2 | $Fe_{72}Co_{10}Mo_2B_{12}C_4$ | " | 24 | 221 | 43 |
| Sample 11 | Paral-lelogram | 2 | " | " | 37 | 42 Small orifices: 2 | $Fe_{60}Ni_{20}Cr_4B_{12}C_4$ | " | " | 74.5 | 48 |
| Sample 12 | Paral-lelogram | 1.5 | " | " | 30 | 130 Small orifices: 2 | $Fe_{54}Ni_{20}Cr_{10}B_{12}C_4$ | " | " | 222 | 40 |
| Sample 13 | Trapezoid | 2 | " | " | 37 | 14 Small orifices: 2 | $Cu_{66}Ti_{34}$ | " | " | 25.5 | 54 |
| Sample 14 | Paral-lelogram | 4 | " | 0.6 | 45 | 16 Small orifices: 2 | $Fe_{91.4}Si_{8.6}$ | 0.3 | 11 | 25 | 82 |
| Sample 15 | Paral-lelogram | 2 | " | 1 | " | 14 Small orifices: 2 | $Fe_{87.9}Si_{121}$ | " | " | " | 68 |
| Sample 16 | Paral-lelogram | " | " | " | " | " | $Fe_{73.3}Cr_{19.2}Ni_{7.5}$ | " | " | " | 72 |
| Sample | Paral-lelogram | " | " | " | " | " | $Fe_{70.2}Cr_{20.1}Al_{9.7}$ | " | " | " | 71 |
| Sample 18 | Paral-lelogram | " | " | " | " | " | $Fe_{59.4}Mn_{28.5}Si_{121}$ | " | 14 | " | 56 |

| | Strip shape Thickness ratio | Magnetic properties W 13/50 | W 1/10K | μ | B | 180° Bending Free surface/ Roll surface | T.S. | Corrosion-resistance | Amorphous/ crystalline | Remarks |
|---|---|---|---|---|---|---|---|---|---|---|
| Sample 1 | 94.6% | 0.102 w/kg | — | — | $B_1$ 1.52 | O/O | kg/ton L 252 | — | Amorphous | Edge sharpness |
| Sample 2 | — | — | — | — | — | O/Δ | — | — | Amorphous | Edge sharpness |
| Sample 3 | 96.5 | 0.110 | — | — | $B_1$ 1.54 | O/Δ | — | — | Amorphous | |
| Sample 4 | 95.9 | 0.096 | — | — | $B_1$ 1.54 | O/O | — | — | Amorphous | |
| Sample 5 | 96.8 | 0.120 | — | — | $B_1$ 1.56 | O/O | L 320 | — | Amorphous | |
| Sample 6 | 96.8 | 0.095 | — | — | $B_1$ 1.53 | O/O | — | — | Amorphous | |
| Sample 7 | 95.6 | 0.096 | W/kg 1.0 | $\mu_s$ 6,000 | $B_s$ 1.3 | O/O | — | — | Amorphous | |
| Sample 8 | 94.8 | — | — | $\mu_i$ 55,000 | $B_s$ 0.7 | O/O | — | — | Amorphous | |
| Sample | 95.8 | 0.130 | — | $\mu_{50}$ 180,000 | $B_s$ 1.5 | O/O | L 210 C 187 | — | Amorphous | |
| Sample 10 | 95.4 | 0.128 | — | $\mu_{50}$ 180,000 | $B_s$ 1.5 | O/O | L 203 C 179 | — | Amorphous | |
| Sample 11 | 96.2 | — | — | — | — | O/O | — | 30% | Amorphous | |
| Sample 12 | 95.4 | — | — | — | — | O/O | — | | Amorphous | |
| Sample 13 | 93.2 | — | — | — | — | O/O | — | — | Amorphous | |
| Sample 14 | 90.4 | 0.71 | — | — | $B_1$ 1.12 | O/O | — | — | Crystalline | |
| Sample | 91.5 | 0.73 | — | — | $B_1$ | X/X | — | — | Crystalline | |

TABLE 1-continued

| | | | | | | | | | |
|---|---|---|---|---|---|---|---|---|---|
| 15 | | | | | 1.10 | | | | |
| Sample 16 | 92.4 | — | — | — | — | O/O | L 60 | — | Crystalline |
| Sample 17 | 92.1 | — | — | — | — | O/O | L 62 C 55 | — | Crystalline |
| Sample 18 | 93.1 | — | — | — | — | O/O | — | — | Crystalline |

*In the TS column, L is tensile strength in the strip longitudinal direction, and C in the width direction.

Table 1 shows data relating to shape, magnetic properties, 180-degree bend-testing, tensile strength testing, corrosion-resistance and other such properties of examples of strip of various alloys manufactured using the nozzle according to the present invention. 180° bending, free surface/roll surface refers to the situation where the strip is bent back 180° into fact-to-face contact with itself with the free surface on the outside. The free surface is the surface of the solidified strip which does not contact the shell surface upon solidification. The roll surface is the surface of the solidified strip which contacts the chell surface upon solidification. Strip thickness ratio is the ratio of the thickness calculated according to weight to the thickness measured using a micrometer. That is, thickness ration is the ratio of the computed sheet thickness based upon weight to the actual sheet thickness as measured by a micrometer. Magnetic properties data are figures obtained after annealing. For amorphous strip, annealing conditions were 60 minutes at 380° C. in an N2 atmosphere and a field strength of 40 Oe. Crystalline strip was annealed at 1,100° C. for 60 minutes in a vacuum (down to $10^{-4}$ torr). Ni is initial permeability, $\mu 5$ is the permeability at 5 mOe and $\mu 50$ at 50 mOe. The corrosion-resistance test was according to the method of JIS Z-23711 (Salt Water Exposure Method; equivalent to the U.S. Salt Spray Test). All strip was subjected to x-ray diffraction and differential scanning calorimetry to confirm amorphosity.

In Table 1, W1/10K stands for the core loss at a frequency of 10 KHz and a magnetic flux density of 1 Tesla. W13/50 stands for the core loss at a frequency of 50 Hz and a magnetic flux density of 1.3 Tesla.

Thickness ratios were high, all over 90%. Thickness ratios exceeding 90% are high and are on a par with those for strip manufactured according to the conventional method.

Figure 4:
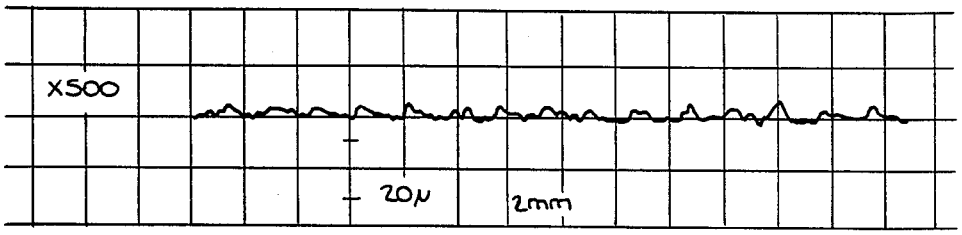
FIG. 4 illustrates a profile of a free surface in the width direction of strip produced according to a first embodiment of the present invention.
Figure 5:
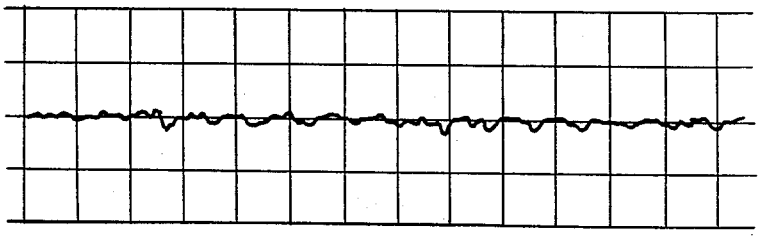
FIG. 5 illustrates a profile of a free surface in the width direction of strip produced according to a third embodiment of the present invention.
Figure 6:
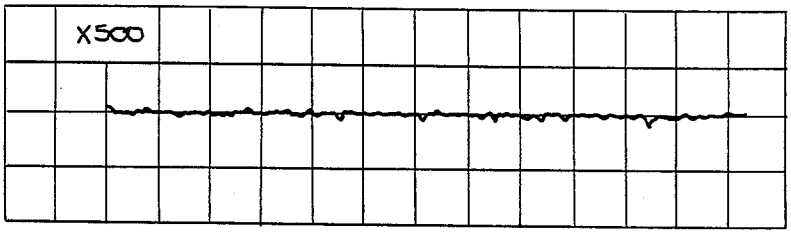
FIG. 6 illustrates a profile of a free surface in the width direction of strip produced according to a fourth embodiment of present invention.
Figure 7:
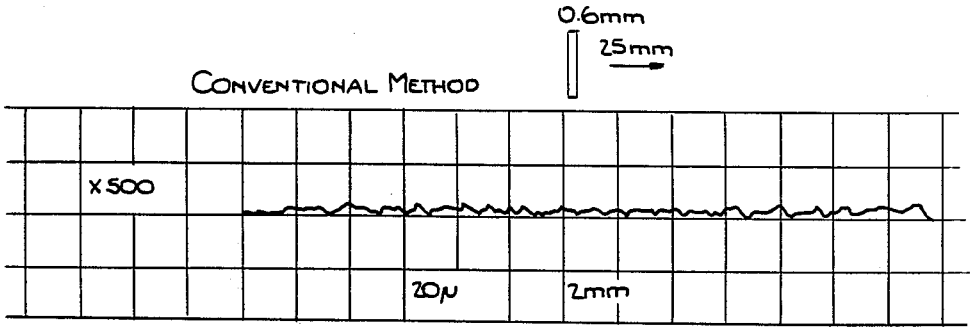
FIG. 7 illustrates a profile of a free surface in the width direction of strip produced according to a conventional method (slot method)

The surface (free surface) characteristics of strip obtained in Examples 1, 3 and 4 are shown in FIGS. 4, 5 and 6, respectively. These data are equivalent to those for the surface characteristics of strip produced by the conventional method shown in FIG. 7.

Thickness deviation in the width direction was examined with respect to strip obtained in the Examples 1, 6, 9, and 10. It was found that even when strip width was increased, there were virtually no differences in thickness deviation, in each case the figure not exceeding 10%. Also, while flume-shaped warping was often seen in the width direction of wide trip manufactured according to a conventional method, such flume-shaped warps were almost entirely absent in strip manufactured according to the method of the present invention.

Thus, as has been described in the above, adoption of the method of this invention enables metal strip of a desired large width to be manufactured, and substantially without any lowering of the space factor.

As the method according to this invention allows the production of, for example, wide Fe amorphous alloy strip, it can be applied to large wound or laminated core transformers. It is also well suited for use with magnetic shielding materials, decorative and other building materials and, if plated with copper or other such high-conductivity metal, as electro- magnetic-frequency shielding material, especially as a material for the blinds used in electromagnetic dark-rooms.

At present the widest amorphous alloy strip that can be obtained is around 10 cm wide. The method according to the present invention eliminates the conventional necessity to resort to brazing or the like in order to increase the width of the available strip. Also, the strip can be cut into thin slices to form composite reinforced material which can be copper-plated and made into spirals for use as coaxial cable shielding.

What is claimed is:

1. A method for manufacturing a metal strip by depositing molten metal on a moving chill surface comprising:

moving said chill surface in a predetermined direction of movement;

arraying a plurality of elongated orifices at approximately a right angle to said direction of movement of said chill surface, wherein each of said elongated orifice has a longitudinal centerline;

positioning the longitudinal centerline of each elongated orifice at an angle of from 10 to 80 degrees with respect to said direction of movement of said chill surface;

ejecting molten metal from said elongated orifices onto said moving chill surface; and rapidly solidifying said molten metal ejected onto said moving chill surface thereby forming said metal strip.

2. A method according to claim 1 wherein the longitudinal centerline of each elongated orifice is positioned at an angle of from 26 to 48 degrees with respect to said direction of movement of said chill surface.

3. A method according to claim 1 or 2 wherein each orifice has a discharge end and said discharge end is spaced at a distance of from 0.,05 to about 3.0 mm from said chill surface.

4. A method according to claim 3 wherein said chill surface moves at a speed of from 5 to 50 m/sec.

5. A method according to claim 1 or 2 wherein said rapidly solidified metal strip is an amorphous metal strip.

6. A method according to claim 1 or 2 wherein said rapidly solidified metal strip is a crystalline metal strip.

7. A nozzle for the manufacture of metal a trip on a chill surface moving in a predetermined direction, said nozzle comprising:

a nozzle discharge end having a longitudinal length between a first edge portion and an opposite second edge portion and a longitudinal centerline, said nozzle discharge end longitudinal length and longitudinal centerline being adapted for positioning at approximately right angles to said predetermined direction of movement of said chill surface;

said nozzle discharge end having a width, said width having a width centerline perpendicular to said nozzle discharge end longitudinal centerline, said nozzle discharge end width being adapted for positioning approximately parallel to said predetermined direction of movement of said chill surface;

a plurality of elongated orifices arrayed along said length of said nozzle discharge end, each elongated orifice having a longitudinal centerline, with each elongated orifice longitudinal centerline forming an angle of from 10 to 80 degrees with respect to said nozzle discharge end with centerline.

8. A nozzle according to claim 5 wherein each elongated orifice centerline from an angle of from 26 to 48 degrees with respect to said nozzle discharge end width centerline.

9. A nozzle according to claim 5 or 6 wherein said elongated orifices have a geometric shape selected from the group consisting of parallelogram, trapezoid, and ellipsoid.

10. A nozzle according to claim 7 wherein said first edge portion and said second edge portion of said nozzle discharge end are each provided with an orifice smaller in area have a geometric shape selected from the group consisting of triangle, parallelogram and trapezoid.

11. A nozzle according to claim 7 wherein said elongated orifices have the geometric shape of a parallelogram, wherein for each elongated orifice the parallelogram has a base (d) having a dimension of from 0.1 to 2.0 mm; the parallelogram has a height (a) parallel to the nozzle discharge end width centerline, said height (a) having a dimension of from 0.5 to 8.0 mm; between sides of adjacent parallelograms there is a separation distance (b) parallel to the nozzle discharge end longitudinal centerline, said separation distance (b) having a dimension of from 0.2 to 3.0 mm; and between sides of adjacent parallelograms there is a distance (c) parallel to the nozzle discharge end width centerline, said distance (c) having a dimension of from 0.2 to 4.0 mm.

12. A nozzle according to clam 9 wherein said elongated orifices have the geometric shape of a trapezoid, wherein for each elongated orifice the trapezoid has and upper side ($d_1$) and a lower side ($d_2$), each side ($d_1$, $d_2$) having a dimension of from 0.1 to 6.0 mm; the trapezoid has a height (a) parallel to the nozzle discharge end width centerline, said height (a) having a dimension of from 0.5 to 8.0 mm; between sides of adjacent trapezoids there is a separation distance ($b_1$) and ($b_2$) parallel to the nozzle discharge end longitudinal centerline, said separation distance ($b_1$, $b_2$) having a dimension of from 0.2 to 6.0 mm; and between sides of adjacent trapezoids there is a distance (c) parallel to the nozzle discharge end width centerline, said distance (c) having a dimension of from 0.2 to 4.0 mm.

13. A nozzle according to claim 9 wherein said elongated orifices have a geometric shape of a n ellipsoid, wherein for each elongated orifice the ellipsoid has a short diameter of from 0.1 to 3.0 mm and a long diameter of from 0.5 to 10 mm, and between sides of adjacent ellipsoids there is a narrowest separation distance of 0.2 mm.

14. An apparatus for manufacturing metal strip by depositing molten metal on a moving chill surface, said apparatus comprising:

means providing said moving chill surface for movement in a predetermined direction of movement;

a nozzle having a discharge end disposed above said chill surface with said nozzle discharge end facing said chill surface, said nozzle discharge end having a plurality of elongated orifices arrayed at approximately a right angle to said direction of movement of said chill surface, each of said elongated orifices having a longitudinal centerline position at an angle of from 10 to 80 degrees with respect to said direction of movement of chill surface.

15. An apparatus according to claim 14 wherein the longitudinal centerline of each elongated orifice is positioned at an angle of from 26 to 48 degrees with respect to said direction of movement of said chill surface.

16. An apparatus according to claim 14 or 15 wherein said nozzle discharge end is spaced from about 0.05 to 3.0 mm from said chill surface.

17. An apparatus according to claim 16 wherein said elongated orifices have a shape selected from the group consisting of parallelogram, trapezoid, and ellipsoid.

18. An apparatus according to claim 17 wherein said nozzle discharge end has a first edge portion and an opposite second edge portion with said first edge portion and said second edge portion each being provided with an orifice smaller in area than said elongated orifices, and said orifices smaller in area have a geometric shape selected from he group consisting of triangle, parallelogram, and trapezoid.

* * * * *

UNITED STATES PATENT AND TRADEMARK OFFICE

CERTIFICATE OF CORRECTION

PATENT NO. : 4,842,041

DATED : June 27, 1989

INVENTOR(S) : Y. Sato et al.

It is certified that error appears in the above-identified patent and that said Letters Patent is hereby corrected as shown below:

In Col. 7, line 19, change "shell" to -- chill --.
In Col. 7, line 21, change "chell" to -- chill --.
In claim 1, line 9, change "orifice" to -- orifices --.
In claim 3, line 3, change "0.,05" to -- 0.05 --.
In claim 7, line 1, change "a trip" to -- strip --.
In claim 7, last line, change "with" to -- width --.
In claim 8, line 1, change "5" to -- 7 --.
In claim 8, line 2, after "orifice" insert -- longitudinal --.
In claim 8, line 2, change "from" to -- forms --.
In claim 9, line 1, change "5 or 6" to -- 7 or 8 --.
In claim 10, line 4, after "area" insert -- than said elongated orifices and said orifices smaller in area --.
In claim 12, line 1, change "clam" to -- claim --.
In claim 12, line 3, change "and" to -- an --.
In claim 13, line 2, change "a n" to -- an --.
In claim 14, line 12, change "position" to -- positioned --.
In claim 18, line 7, change "he" to -- the --.

Signed and Sealed this

Twenty-ninth Day of October, 1991

*Attest:*

*Attesting Officer*

HARRY F. MANBECK, JR.

*Commissioner of Patents and Trademarks*